US008789907B2

(12) United States Patent
Vall et al.

(10) Patent No.: US 8,789,907 B2
(45) Date of Patent: Jul. 29, 2014

(54) PROCESSING PRINTHEAD CONTROL DATA AND PRINTING SYSTEM

(71) Applicant: Hewlett-Packard Development Company, L.P., Houston, TX (US)

(72) Inventors: Marc Serra Vall, Barcelona (ES); Eduardo Amela Conesa, Lleida (ES); Jaime Fernandez Del Rio, San Diego, CA (US); Jacint Humet Pous, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 47 days.

(21) Appl. No.: 13/691,320

(22) Filed: Nov. 30, 2012

(65) Prior Publication Data

US 2014/0152727 A1 Jun. 5, 2014

(51) Int. Cl.

| | |
|---|---|
| ***B41J 29/38*** | (2006.01) |
| ***B41J 29/393*** | (2006.01) |
| ***B41J 11/00*** | (2006.01) |

(52) U.S. Cl.

CPC ..... *B41J 29/393* (2013.01); *B41J 11/008* (2013.01); *B41J 11/0065* (2013.01)

USPC ..... 347/12

(58) Field of Classification Search

CPC ..... B41J 29/393; B41J 11/008; B41J 11/0065

USPC ..... 347/9–12, 14, 15, 19, 40–43

See application file for complete search history.

(56) References Cited

U.S. PATENT DOCUMENTS

| | | | | |
|---|---|---|---|---|
| 6,688,726 | B2 | 2/2004 | Bauer | |
| 7,011,383 | B2 * | 3/2006 | Edwards et al. | 347/16 |
| 7,472,983 | B2 | 1/2009 | Fellingham et al. | |
| 7,828,403 | B2 * | 11/2010 | Rueby | 347/12 |
| 7,988,251 | B2 | 8/2011 | Dimitrijevic et al. | |
| 8,336,982 | B2 * | 12/2012 | Vall et al. | 347/14 |
| 2010/0013878 | A1 | 1/2010 | Spaulding et al. | |

OTHER PUBLICATIONS

Boley, J. William; et al., "Coalescence Constraints for Inkjet Print Mask Optimization", 2010 IEEE/ASME Internation Conference on Advanced Intelligent Mechatronics, Montréal, Canada; Jul. 6-9, 2010, pp. 67-72.< http://ieeexplore.ieee.org/search/freesrchabstract.jsp?tp=&arnumber=5695951 >.

Kamasak, Mustafa, et al., "Dynamic Print Mode Control for Inkjet Printing", Purdue University, w. Lafayette, IN 47906, USA. Sep. 30-Oct. 5, 2001; pp. 78-82.< https://engineering.purdue.edu/~bouman/publications/pdf/nip01mustafa.pdf >.

* cited by examiner

*Primary Examiner* — An Do

(57) ABSTRACT

According to one example, a printer includes an inkjet printhead, and the printhead comprises nozzles through which printing fluid is ejectable during a pass of the printhead across a print zone. Processing printhead control data includes obtaining printhead control data describing pixel locations in an image to be printed on a media, and allocating, for a swath of the image, each of the pixel locations to a printhead nozzle and to a print pass of a set of print passes in accordance with a print mask. The print mask defines sections associated different groups of the nozzles.

17 Claims, 11 Drawing Sheets

400

402

| | | | | | | | | | | | |
|---|---|---|---|---|---|---|---|---|---|---|---|
| 1 | 4 | 3 | 4 | 1 | 4 | 3 | 4 | 1 | 4 | 3 | 4 |
| 3 | 4 | 4 | 2 | 3 | 4 | 4 | 2 | 3 | 4 | 4 | 2 |
| 4 | 3 | 1 | 3 | 4 | 3 | 1 | 3 | 4 | 3 | 1 | 3 |
| 3 | 2 | 3 | 4 | 3 | 2 | 3 | 4 | 3 | 2 | 3 | 4 |

404

| | | | | | | | | | | | |
|---|---|---|---|---|---|---|---|---|---|---|---|
| 2 | 1 | 4 | 1 | 2 | 1 | 4 | 1 | 2 | 1 | 4 | 1 |
| 4 | 1 | 1 | 3 | 4 | 1 | 1 | 3 | 4 | 1 | 1 | 3 |
| 1 | 4 | 2 | 4 | 1 | 4 | 2 | 4 | 1 | 4 | 2 | 4 |
| 4 | 3 | 4 | 1 | 4 | 3 | 4 | 1 | 4 | 3 | 4 | 1 |

406

| | | | | | | | | | | | |
|---|---|---|---|---|---|---|---|---|---|---|---|
| 4 | 1 | 2 | 1 | 4 | 1 | 2 | 1 | 4 | 1 | 2 | 1 |
| 2 | 1 | 1 | 3 | 2 | 1 | 1 | 3 | 2 | 1 | 1 | 3 |
| 1 | 2 | 4 | 2 | 1 | 2 | 4 | 2 | 1 | 2 | 4 | 2 |
| 2 | 3 | 2 | 1 | 2 | 3 | 2 | 1 | 2 | 3 | 2 | 1 |

408

| | | | | | | | | | | | |
|---|---|---|---|---|---|---|---|---|---|---|---|
| 1 | 2 | 3 | 2 | 1 | 2 | 3 | 2 | 1 | 2 | 3 | 2 |
| 3 | 2 | 2 | 4 | 3 | 2 | 2 | 4 | 3 | 2 | 2 | 4 |
| 2 | 3 | 1 | 3 | 2 | 3 | 1 | 3 | 2 | 3 | 1 | 3 |
| 3 | 4 | 3 | 2 | 3 | 4 | 3 | 2 | 3 | 4 | 3 | 2 |

FIGURE 4

AFTER 4 ADVANCES

650

AFTER 5 ADVANCES

AFTER 6 ADVANCES

650

AFTER 7 ADVANCES

PROCESSING PRINTHEAD CONTROL DATA AND PRINTING SYSTEM

BACKGROUND

Swath-based inkjet printing systems create a printed image by controlling an inkjet printhead to print an image swath in accordance with printhead control data. An inkjet printhead comprises an array of printhead nozzles through which drops of ink, or other fluid, may be ejected. The printhead control data is derived from an image to be printed and describes the number of ink drops to be deposited by each nozzle of each printhead at different pixel locations on a media.

To overcome problems common in swath-based printing, such as inter-swath banding, printing systems often implement multi-pass printing. In multi-pass printing each swath is generated as a result of multiple passes of a printhead across a print zone. In conjunction with multi-pass printing, print masking techniques are used to temporally distribute the total number of ink drops to be deposited at each pixel location on a media (as described in the printhead control data) over one or multiple printhead passes.

The design of print masks has an important role in defining the performance of a printing system. For example, known print masks that enable high-quality images (such as photo quality) to be printed generally require a high-number of printhead passes, and hence have a low printer throughput. Other print known print masks enable high-speed printing, use, for example, from 2 to 4 printhead passes, but consequently print quality is reduced.

BRIEF DESCRIPTION

Examples, or embodiments, of the invention will now be described, by way of non-limiting example only, with reference to the accompanying drawings, in which:

FIG. 4 is an illustration of a print mask according to one example;

Figure 7:
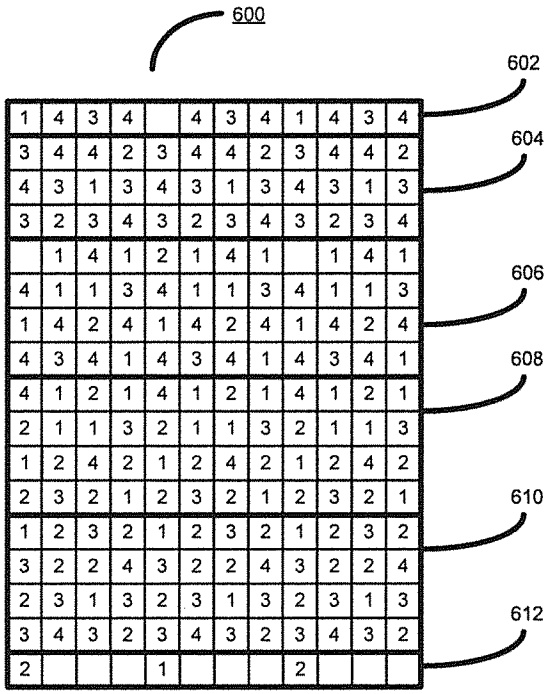
Figure 9:
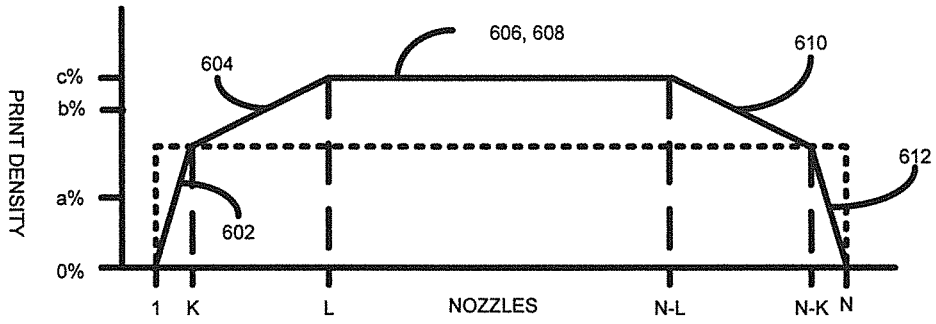
Figure 10:
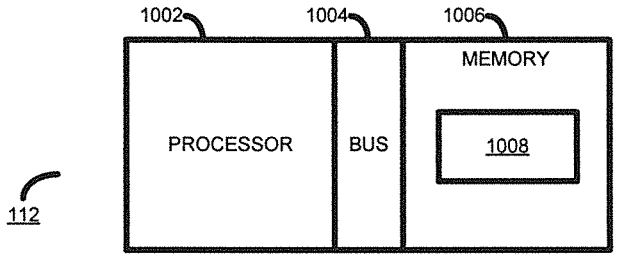
Figure 11:
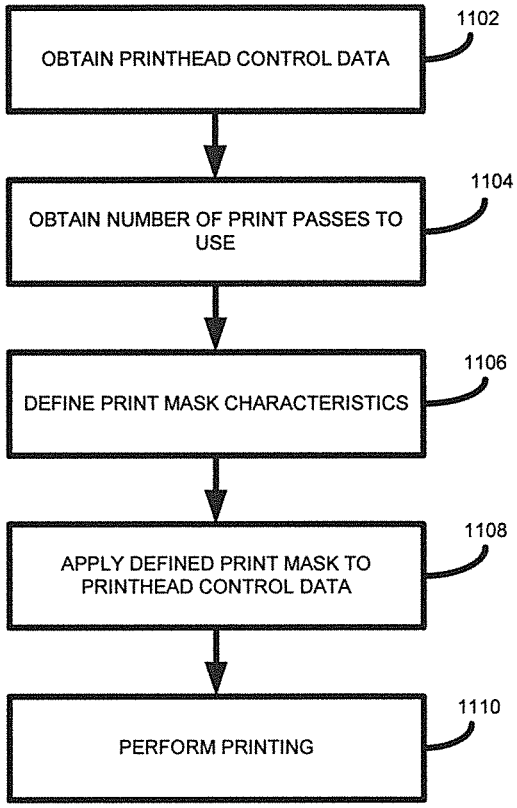

FIGS. 6(A)-(D) are exploded views of a modified print mask according to an example;

FIG. 7 is an illustration of a print mask according to one example;

FIGS. 8(A)-(D) are illustrations showing the progression of printing using a print mask according to one example;

FIG. 9 is a graph illustrating the print density of a print mask according to an example;

FIG. 10 is a block diagram of a printer controller according to one example; and FIG. 11 is a flow diagram outlining a method of operating a printing system according to one example.

DETAILED DESCRIPTION

In so-called scanning inkjet printers, a printhead scans, or moves, across a media ejecting drops of printing fluid thereon. Printing fluid may include ink, primer, or post-treatment fluid. Hereinafter use of the term ink should, unless the context suggests otherwise, be understood to cover any suitable printing fluid including both ink and non-ink printing fluids.

Each time the printhead moves across a print zone is known as a print pass, or simply a pass. An image swath is generally generated as a result of multiple passes of a printhead over the print zone. With each pass of the printhead over the media the printhead prints a portion of the image swath on a media. The portion of each image swath printed during each printhead pass is determined by a print mask.

In known printing systems, after an image swath is completely printed the media is advanced under the printhead, and a subsequent image swath is printed in the same manner. In this way a printed image is produced swath-by-swath in an incremental manner.

In some printing systems the media is advanced under the printhead after each pass of the printhead. In such systems the media is generally advanced by a distance d, where:

$$d = \text{Swath Height}/\text{Number of Printhead Passes}$$

Figure 1:
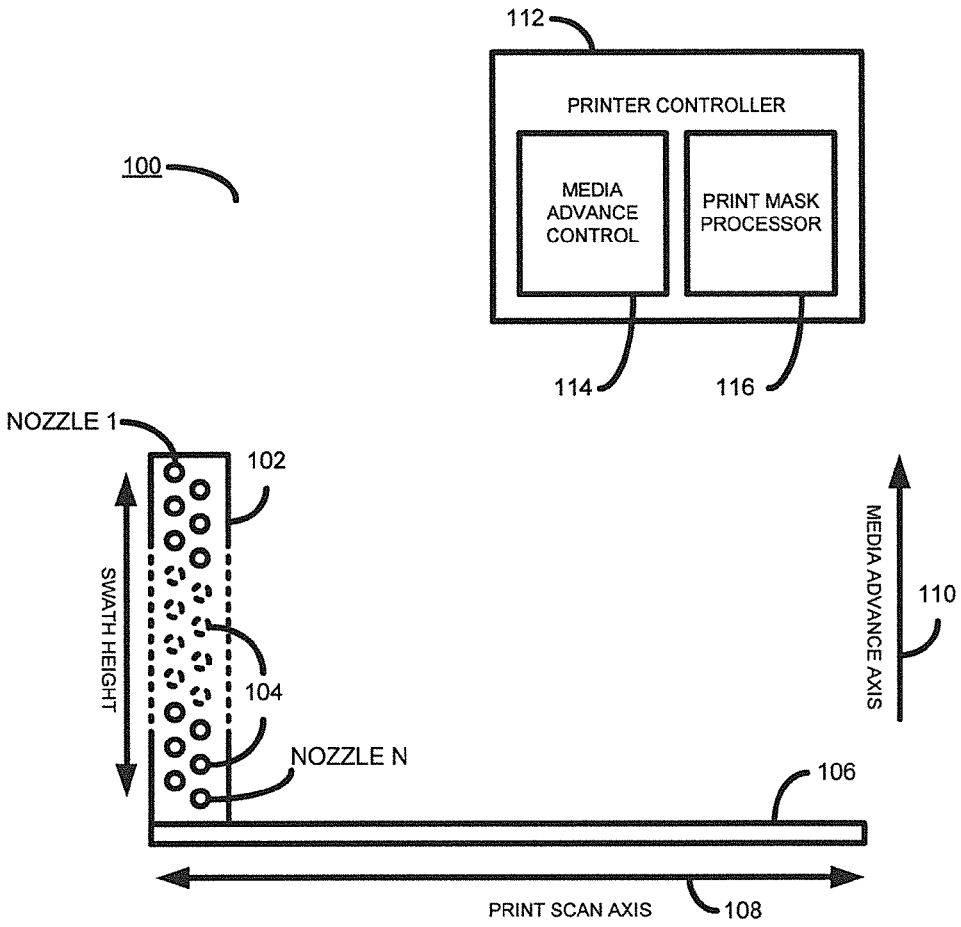
FIG. 1 is a block diagram of a part of a printing system according to one example.

Referring now to FIG. 1 there is a shown a block diagram of a part of a printing system 100 according to one example. It will be appreciated that, for clarity, not all parts of the printing system 100 are shown.

An inkjet printhead 102 comprises an array of printhead nozzles 104 through which ink or printing fluid may be ejected. In one example the printhead 102 is a thermal inkjet printhead from which liquid ink or printing fluid is ejectable through nozzles 104 by selectively applying an electrical current to a nozzle actuator (not shown), such as a resistor, associated with each nozzle. In other examples a piezo inkjet printhead may be used to eject ink or fluid drops. Ink may be supplied to the printhead 102 and nozzles 104 in any suitable manner, for example from an ink supply system (not shown). In some examples, the printing system 100 may comprise multiple printheads, for example with each printhead being used to eject different colored ink. However, for clarity in the following description reference is made only to a single printhead.

In the present example the nozzles 104 are arranged in a two-dimensional array giving an effective one-dimensional array of nozzles along a media advance axis 110. The nozzles 104 are equally spaced from one another along the media advance axis 110. A typical printhead may have from a few hundred to many thousands of nozzles. In the examples shown herein, however, only a small number of nozzles are shown for reasons of clarity. However, in other examples other nozzle arrangements may be used. The distance between the two nozzles situated at each extremity of the printhead in the media advance axis is referred to as the swath height.

The printhead 102 is moveable bi-directionally along a carriage bar 106 in a print scan axis 108. In one example the printhead 102 is installed on a printhead carriage (not shown) which is mounted on the carriage bar 106.

Media is advanced in a direction substantially perpendicular to the print scan axis, along the media advance axis 110. Media is advanced by a media handling system (not shown) that may include rollers, belts, or any other suitable media advance elements. The media handling system is controlled by a media advance controller 114.

The printing system 100 is generally controlled by the printer controller 112. The controller 112 obtains printhead control data derived from an image to be printed, and uses the obtained data to control the printing system 100 to print an image on a sheet or web of media. For example, the printer controller 112 controls the printhead 102 to scan or move along the carriage bar 106 along the print scan axis 108 and to eject ink or printing fluid drops from nozzles 104 of the printhead in accordance with the printhead control data.

The printhead control data is derived from an image to be printed, for example by performing appropriate image processing on the image. The printhead control data maps spatial assignments of ink drops to pixels on a media. Thus, the printhead control data defines, for each media pixel location, the total number of ink drops to be deposited in order to produce the image to be printed.

As is well understood, however, in many circumstances it is generally undesirable to deposit a large number of ink drops on a media in a single printhead pass. A print masking process is therefore generally performed on the printhead control data to establish a temporal assignment of ink drops during each pass of a printhead across a print zone. A print mask is a binary pattern that defines which media pixel locations are printable in a given pass.

Figure 2:
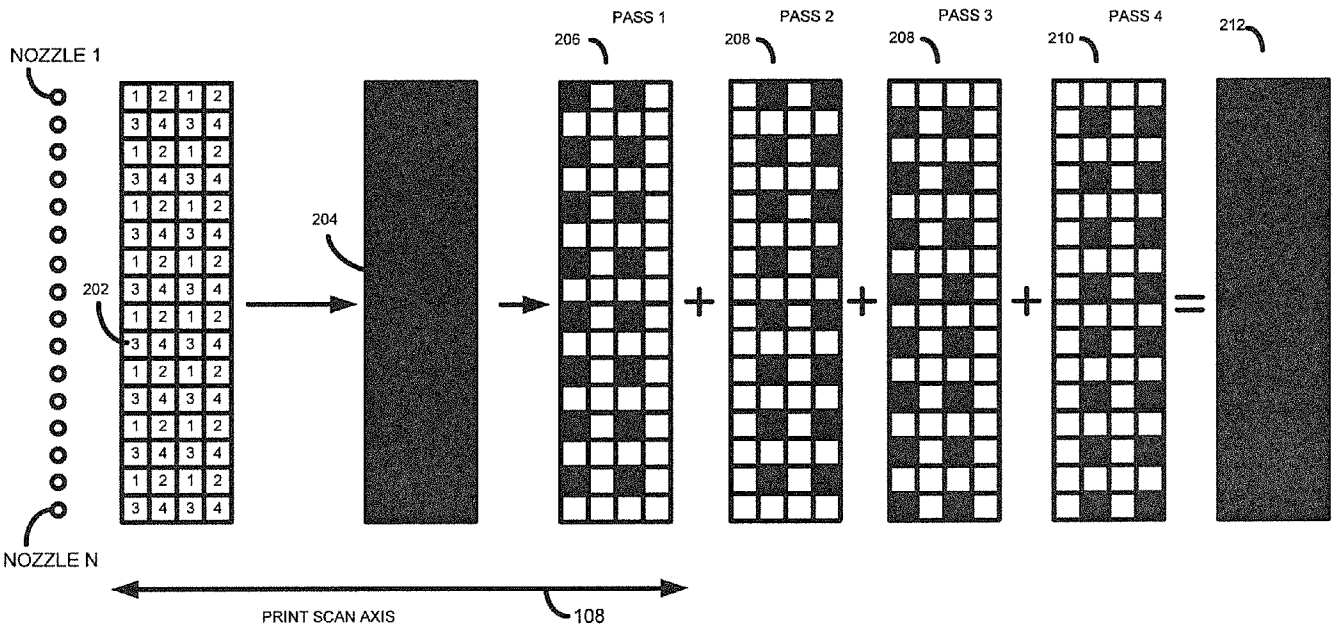
FIG. 2 is an illustration outlining the principles of print masking.

The basic principles of print masking are illustrated in FIG. 2. For the purposes of explanation a simplified print mask is shown.

In the example shown, a print mask 202 defines a repeating 4 by 4 grid that indicates which media pixel locations are printable in any given printhead pass. In other examples other print mask designs may be used.

Each row of the print mask 202 is associated with a nozzle on a printhead. In the example shown in FIG. 2, the print mask 202 has one row for each of the printhead nozzles 1 to N.

Every pixel location within the print mask is thus allocated to both a printhead nozzle and to a print pass.

In this example the print mask 202 is designed for use with four printhead passes.

The print mask 202 is applied to a portion 204 of an image to be printed. In a first printhead pass, only those media pixel locations to be printed that correspond to those media pixel locations defined in the print mask 202 as to be printed in the first printhead pass are printable. Thus, if the portion of the image to be printed is a solid filled area, in a first printhead pass those media pixel locations shown in portion 206 are printed. In subsequent printhead passes different ones of the pixels to be printed are printed in each printhead pass, as defined by the print mask 202, until all of the media pixel locations to be printed have been printed (as illustrated in portion 212).

In the present example, after four printhead passes the media is advanced by the swath height of the printhead, and a subsequent swath is printed in the same manner.

The example illustrated in FIG. 2 represents a so-called uniform print mask, since in each printhead pass the total number of printable media pixel locations is the same—in this case 25% (1/N, where N is the number of printhead passes). The percentage of printable pixel locations in a given pass for a given group of nozzles is referred to herein as the print density.

Figure 3:
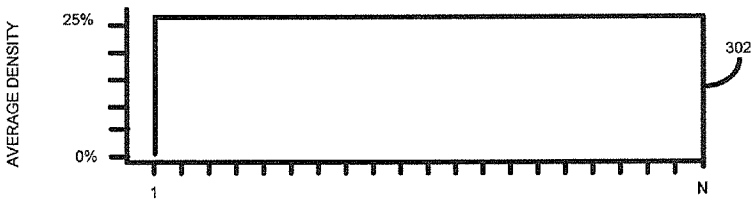
FIG. 3 is a graph showing the print density of the print mask of FIG. 2.

FIG. 3 shows a representation 302 of such a uniform print mask. The x-axis represents each of the nozzles 1 to N, and the y-axis represents the average print density ejectable by the nozzles 1 to N during each printhead pass.

Referring now to FIG. 4 there is shown an illustration of a print mask 400 comprising multiple print mask sections 402, 404, 406, and 408, according to one example.

In the present example, and for reasons of clarity, the print mask sections shown in FIG. 4 are designed for a notional printhead having 16 nozzles. In a real situation, however, it will be appreciated that a printhead may have many hundreds or thousands of nozzles. It will be appreciated, however, that the concepts and teachings described herein are scalable for use with printheads having many hundreds or thousands of nozzles.

Each of the print mask sections 402, 404, 406, and 408, correspond, for a given print head pass, to a respective to a group of printhead nozzles.

Each row of each print mask section defines the media pixel locations that are printable by an associated printhead nozzle during a given printhead pass. Thus, printable pixel locations identified as '1' are printable only in a first pass, printable pixel locations identified as '2' are printable only in a second print pass, and so on.

It will be understood that the print mask designs described in the present description and as shown in the accompanying drawings are examples only. Accordingly, changes may be made to print mask designs whilst remaining within the scope of the examples described herein.

Figure 5:
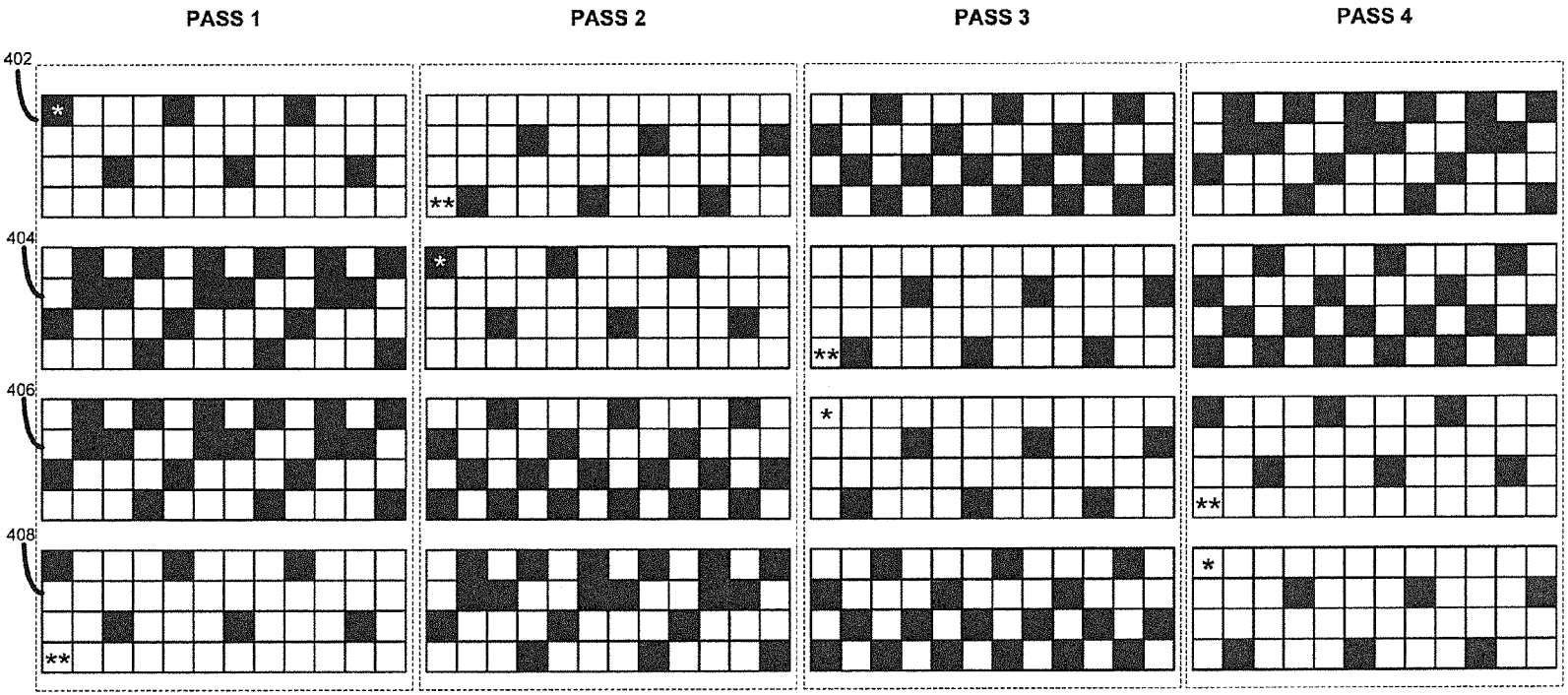
FIG. 5 is an exploded view of the print mask of FIG. 4 according to one example.

FIG. 5 shows each of the print masks 402, 404, 406, and 408 in an exploded view showing, for each print pass, those pixels printable by a given nozzle in a given printhead pass. For each printhead pass an asterisk is shown to the left of the print mask section that corresponds to a first nozzle on a printhead, and a double asterisk '' is shown to the left of the print mask section that corresponds to a last nozzle on a printhead. The print mask sections for passes 2, 3, and 4, thus effectively wrap-around vertically, as is more clearly shown in FIG. 6**.

In FIG. 5 it can be clearly seen that in any given printhead pass the number of printable pixel locations varies for each print mask section 402, 404, 406, and 408. In this way, different print passes for a given print mask section have different print densities.

For example, in printhead pass 1, the print density of print mask 402 is 12.5%, the print density of print mask 404 is 37.5%, the print density of print mask 406 is 37.5%, and the print density of print mask 408 is 12.5%.

The design of the print masks 402, 404, 406, and 408, thus provides, in any given print pass, that those printable pixel locations printed by the groups of nozzles at each extremity of a printhead have a lower print density than the intermediate nozzles. As will be described further below, this arrangement is particularly advantageous in reducing inter-swath banding.

In other examples each print mask may be designed such that in any given printhead pass each group of nozzles has other print densities.

An overview of how to operate the printing system 100 using the print masks described herein will now be given, with additional reference to FIGS. 6 to 11.

In the present example the print mask for a first and second print pass is modified by selecting a portion of the print mask section associated with the first group of nozzles at the leading edge of a printhead. The selected portion is moved from the original print mask section and is added to an additional print mask section associated with a group of nozzles at the trailing edge of the printhead, shown in FIG. 6.

In FIG. 6 the moved portion of the print mask sections is shown in hashed shading.

Figure 6A:
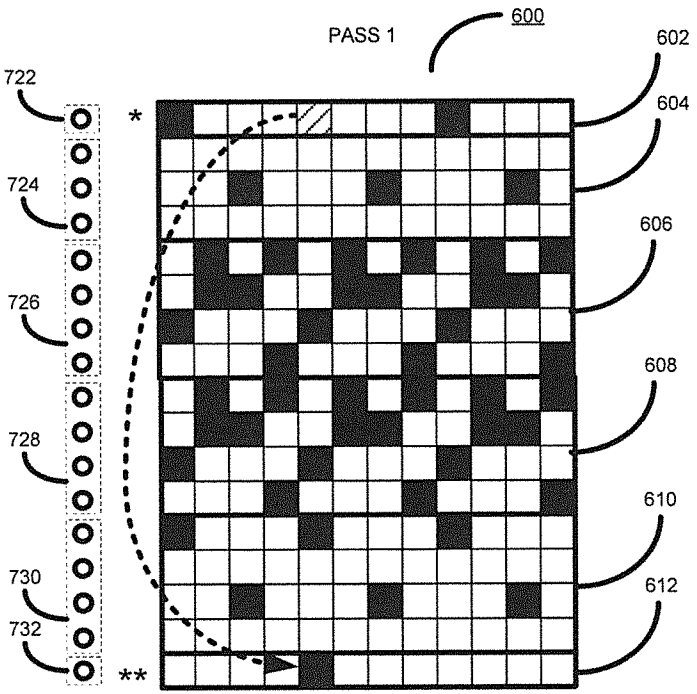

FIG. 6*a* shows an example print mask 600 for a first printhead pass. A first print mask section 602 is associated with a first nozzle group 722, a second print mask section 604 is associated with a second nozzle group 724, a third print mask section 606 is associated with a third nozzle group 726, a fourth print mask section 608 is associated with a fourth nozzle group 728, a fifth print mask section 610 is associated with a fifth nozzle group 730, and a sixth, or the additional, print mask section 612 is associated with a sixth nozzle group 732.

In this example, the print mask sections 602, 604, 606, 608, 610, and 612, are for thus associated with 17 printhead nozzles, although in other examples they may be associated with different numbers of printhead nozzles.

Figure 6B:
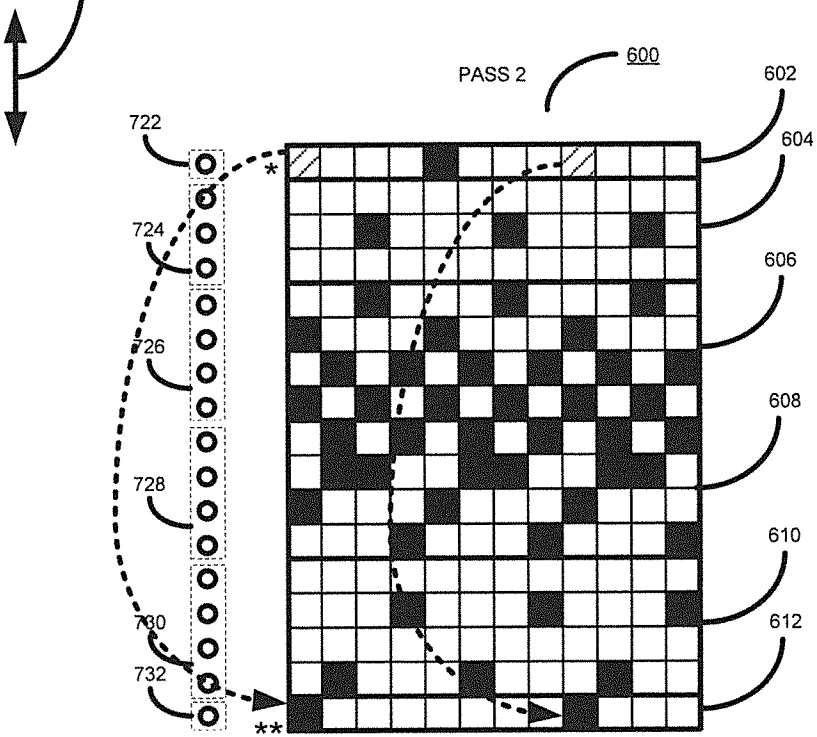

FIG. 6*b* shows the print mask 600 for a second printhead pass. A first print mask section 602 is associated with a first nozzle group 722, a second print mask section 604 is associated with a second nozzle group 724, a third print mask section 606 is associated with a third nozzle group 726, a fourth print mask section 608 is associated with a fourth nozzle group 728, a fifth print mask section 610 is associated with a fifth nozzle group 730, and a sixth print mask section 612 is associated with a sixth nozzle group 732.

Figures 6C, 6D:
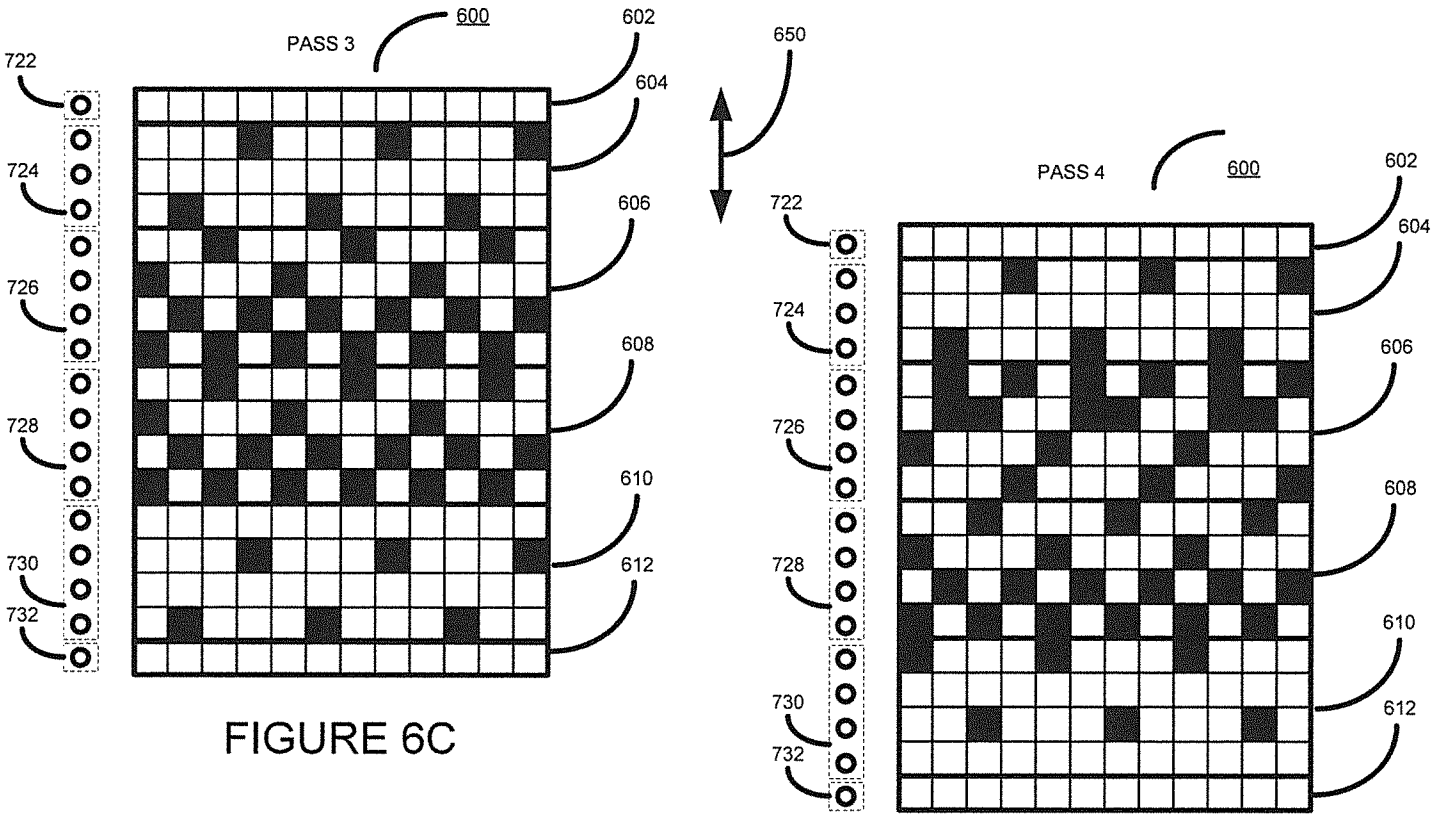

FIG. 6*c* shows the print mask 600 for a third printhead pass. A first print mask section 602 is associated with a first nozzle group 722, a second print mask section 604 is associated with a second nozzle group 724, a third print mask section 606 is associated with a third nozzle group 726, a fourth print mask section 608 is associated with a fourth nozzle group 728, a fifth print mask section 610 is associated with a fifth nozzle group 730, and a sixth print mask section 612 is associated with a sixth nozzle group 732.

FIG. 6*d* shows the print mask 600 for a fourth printhead pass. A first print mask section 602 is associated with a first nozzle group 722, a second print mask section 604 is associated with a second nozzle group 724, a third print mask section 606 is associated with a third nozzle group 726, a fourth print mask section 608 is associated with a fourth nozzle group 728, a fifth print mask section 610 is associated with a fifth nozzle group 730, and a sixth print mask section 612 is associated with a sixth nozzle group 732.

The print mask 600 effectively has five different sections of different print densities. A first and fifth section 602 and 612 have a first average print density, a second and fourth section 604 and 610 have a second average print density that is higher than the first average print density, and a third section (the combination of sections 606 and 608 since they have the same average print density) that has a third average print density that is higher than the second average print density.

The print mask 600 is shown in more compact form in FIG. 7

When printing, a first printhead pass is made printing those printable pixel locations shown in FIG. 6*a*. The media is then advanced by a media advance distance 650 that corresponds to the height of the print mask 600 less the height of the fifth print mask section 612, and divided by the number of print passes being used. In the present example four print passes are used, so the media is advanced by an amount equivalent to the combined height of nozzle sections 722 and 724 (corresponding to print mask sections 602 and 604). It should be noted that in the present examples the media is thus advanced by a distance d which is less than Total Swath Height/Number of Printhead Passes In this regard, the media can be considered to be under-advanced compared to the amount of media advance that would be used for a uniform print mask.

A second printhead pass is made printing those printable pixel locations shown in FIG. 6*b*. The media is then advanced by the aforementioned media advance distance.

A third printhead pass is made printing those printable pixel locations shown in FIG. 6*c*. A fourth printhead pass is made printing those printable pixel locations shown in FIG. 6*c*. The media is then advanced by the aforementioned media advance distance.

A fourth printhead pass is made printing those printable pixel locations shown in FIG. 6*d*. A fourth printhead pass is made printing those printable pixel locations shown in FIG. 6*d*. The media is then advanced by the aforementioned media advance distance.

Subsequent printhead passes are print following the same pattern.

FIG. 8 shows the effect of printing as subsequent print passes and media advances are made.

Figure 8A:
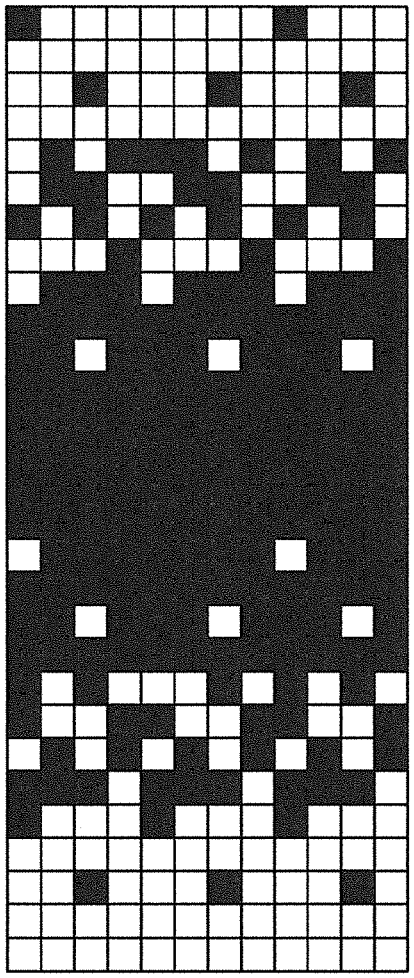

FIG. 8*a* shows those pixel locations printable after 4 print passes, each followed by a media advance, have been performed.

Figure 8B:
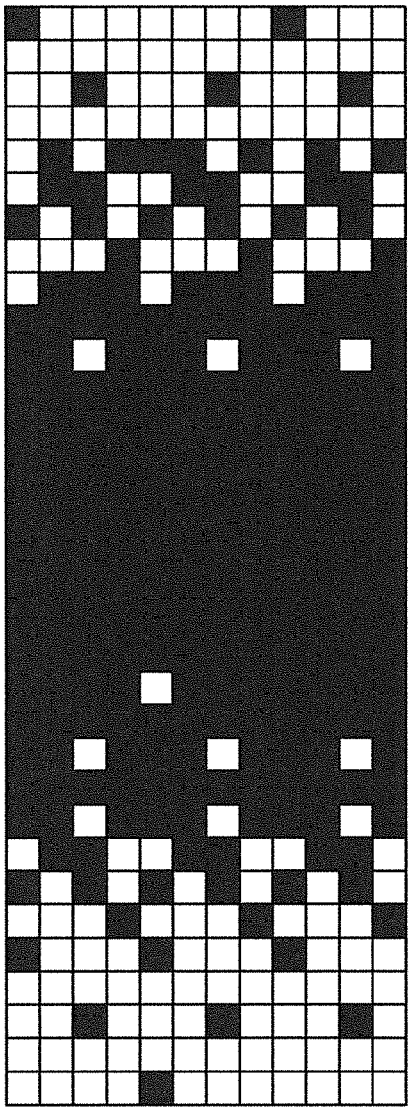

FIG. 8*b* shows those pixel locations printable after 5 print passes, each followed by a media advance, have been performed.

Figure 8C:
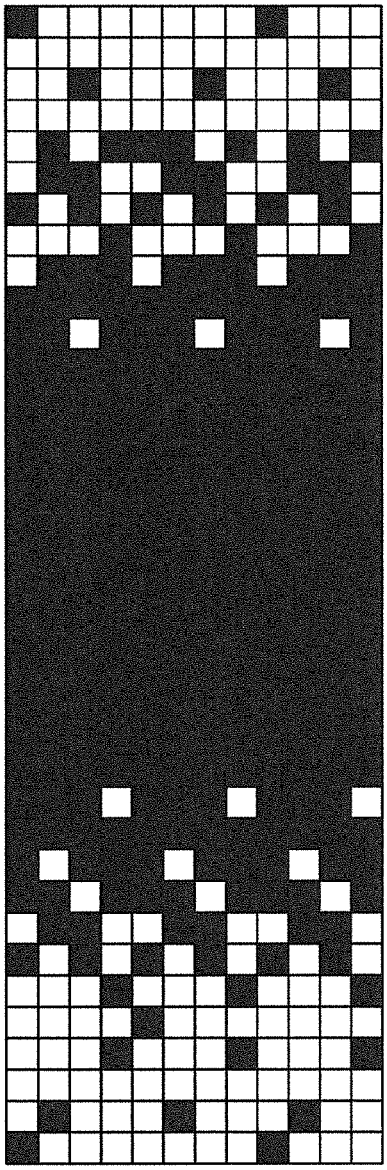

FIG. 8*c* shows those pixel locations printable after 6 print passes, each followed by a media advance, have been performed.

Figure 8D:
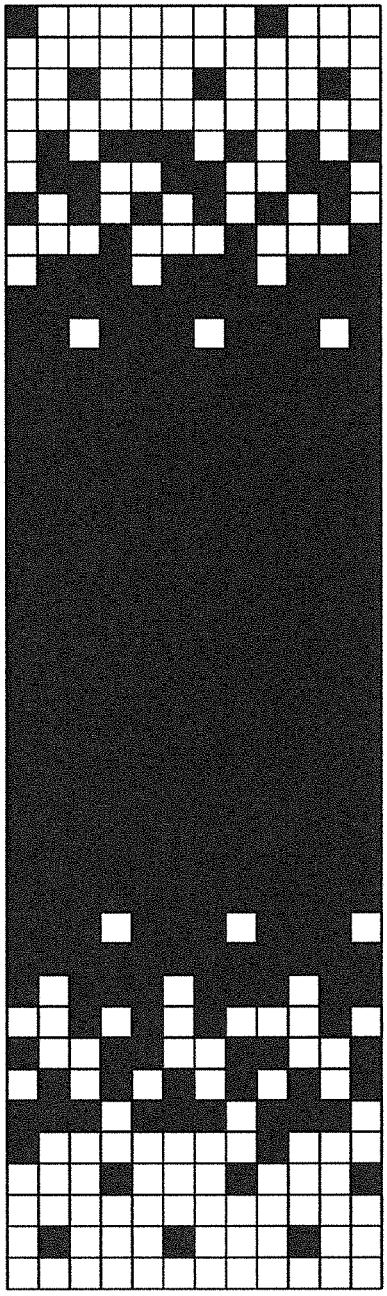

FIG. 8*d* shows those pixel locations printable after 7 print passes, each followed by a media advance, have been performed.

The print density characteristics of the print mask 600 are shown graphically in FIG. 9, in which the x-axis represents the printhead nozzles 1 to N, and in which the y-axis represents print density.

For a given print pass, a first print mask section 602 is associated with nozzles 1 to K. The first print mask section 602 has an average print density a.

A second print mask section 604 is associated with nozzles K to L. The second print mask section 604 has an average print density b.

A third print mask section (combination of 606, 608) is associated with nozzles L to N-L, and has an average print density c.

A fourth print mask section 610 is associated with nozzles N-L to N-K and has an average print density b.

And finally, a fifth print mask section 612 is associated with nozzles N-K to N and has an average print density a.

The amount by which the media is 'under-advanced' corresponds to the distance between the nozzles 1 to K.

The print mask concept described herein is useful for a number of printhead passes ranging from 2, 3, or 4 passes. In other examples, it may be useful with a higher number of printhead passes, although printer throughput will be reduced with a higher number of passes.

For a given printhead having N nozzles it is possible to design a print mask conforming to the concepts described herein by carefully choosing values for each of the different variables K, L, a, b, and c. The choice of values may depend, for example, on the size and type of the printhead, the desired number of printhead passes, the media advance accuracy of the printing system, and the characteristics of the ink, to name just a few.

In one example, for a printhead having, say, N=10 000 nozzles, K may be chosen to be in the range of about 2 to 7% of N. For example, the number of nozzles K may be in the range of about 200 to 700 nozzles. As previously mentioned, the amount by which the media is 'under-advanced' is by a distance corresponding to the height of the number of nozzles K. Accordingly, N-2L may be chosen to be in the range of about 50% of K, in which case L-K may be chosen to be in the range of about 23 to 36% of K. In one example N-2L may be chosen to be at least 50% of K.

In other examples, K may be chosen be in the range of about 7 to 15% of K. In a yet further example, K may be chosen be in the range of about 15 to 20% of K.

Referring now to FIG. 10 the printer controller 112 is shown in greater detail. The controller 124 comprises a processor 1002 such as a microprocessor, a microcontroller, a computer processor, or the like. The processor 1002 is in communication with a memory 1006 via a communication bus 1004. The memory 1006 stores computer implemented instructions 1008 that, when executed by the processor 1002 cause the controller 124 to operate the printing system 100 in accordance with the method described below and as illustrated in FIG. 11 and as described below.

At block 1102 the controller 112 obtains printhead control data of an image to be printed.

At block 1104 the controller 112 determines the number of printhead passes to be used to print the image. The number of passes may be determined, for example, by the printer as part of a default print mode, or may selected by a user, for example through an appropriate user interface.

At block 1106 the controller 112 defines the print mask characteristics, as described above.

At block 1108 the controller 112 applies the defined print masks to the obtained printhead control data. This defines the printhead control data that defines for each printhead pass exactly which media pixel locations are to be printed in each print pass.

At block 1110 the controller 112 controls the printing system to print the image in accordance with the defined print mask.

It will be appreciated that examples and embodiments of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples of the present invention may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features

The invention claimed is:

1. A method of processing printhead control data in a printer comprising an inkjet printhead, the printhead comprising N nozzles through which printing fluid is ejectable during a pass of the printhead across a print zone, the method comprising:

obtaining printhead control data describing pixel locations to be printed on a media, the printhead control data derived from an image to be printed;

allocating, for a swath of the image, each of those pixel locations to be printed to a printhead nozzle and to a print pass of a set of P print passes in accordance with a print mask, wherein the print mask defines:

a first section associated with a first group of nozzles at the leading edge of the printhead having a first average print density;

a fifth section associated with a fifth group of nozzles at the trailing edge of the printhead having a fifth average print density;

a second section associated with a second group of nozzles immediately adjacent the first group of nozzles and having a second average print density;

a fourth section associated with a fourth group of nozzles immediately adjacent the fifth group of nozzles and having a fourth average print density;

a third section associated with a third group of nozzles intermediate the second and fourth groups of nozzles and having a third average print density.

2. The method of claim 1, wherein the average print density of the second and fourth section is higher than the average print density of the first section.

3. The method of claim 1, wherein the average print density of the third section is higher than the average print density of the second or fourth section.

4. The method of clam 1, wherein the average print density of the first and fifth section is substantially the same.

5. The method of claim 1, wherein the average print density of the second and fourth section is substantially the same.

6. The method of claim 1, further comprising printing a portion of a swath in a print pass in accordance with the print mask.

7. The method of claim 6, further comprising advancing after each print pass a media by a distance equivalent to the height of the print mask minus the height of the first print mask section, divided by the number of passes P.

8. The method of claim 6, wherein the distance advanced is less than the printhead swath height divided by the number of passes P.

9. The method of claim 1, wherein the first and fifth print mask sections are each associated with between about 2 to 7% of the printhead nozzles N.

10. The method of claim 1, wherein the second and fourth print mask sections are each associated with between about 23 to 36% of the printhead nozzles N.

11. The method of claim 1, wherein the third print mask section is associated with at least 50% of the printhead nozzles N.

12. The method of claim 1, wherein the number of printhead passes is between 2 and 4.

13. An inkjet printing apparatus comprising a non-transitory storage medium and a processor and having program instructions embodied in the non-transitory storage medium and executable by the processor, wherein the program instructions when executed in the processor cause the processor to implement a method according to claim 1.

14. A swath-based inkjet printing system for printing, using P printhead passes, with a printhead having an array of nozzles, comprising:

a controller to:

receive printhead control data derived from an image to be printed;

control the printing system to print the image to be printed using the printhead such that in each pass of the printhead over a print zone:

a first group of printhead nozzles at the leading edge of the printhead and a second group of printhead nozzles at the trailing edge of the printhead each print with a first average print density;

a third group of printhead nozzles immediately adjacent the first group of printhead nozzles print with a second average print density higher than the first average print density;

a fourth group of printhead nozzles immediately adjacent the second group of printhead nozzles print with the second average print density; and a fifth group of printhead nozzles intermediate the third and fourth groups of printhead nozzles print with a third average print density higher than the second average print density; and advance, after each print pass, a print media under the printhead by a distance less than the printhead swath height divided by the number of printhead passes.

15. The printing system of claim 14, wherein the first and second groups of printhead nozzles each represent between about 2 to 7% of the printhead nozzles in the printhead.

16. The printing system of claim 15, wherein the third and fourth groups of printhead nozzles each represent between about 23 to 36% of the printhead nozzles in the printhead.

17. The method of claim 16, wherein the fifth group of printhead nozzles represents at least 50% of the printhead nozzles in the printhead.

* * * * *

UNITED STATES PATENT AND TRADEMARK OFFICE

CERTIFICATE OF CORRECTION

PATENT NO. : 8,789,907 B2
APPLICATION NO. : 13/691320
DATED : July 29, 2014
INVENTOR(S) : Marc Serra Vall et al.

It is certified that error appears in the above-identified patent and that said Letters Patent is hereby corrected as shown below:

In the Claims

In column 8, line 23, in Claim 4, delete “clam” and insert -- claim --, therefor.

Signed and Sealed this
Second Day of June, 2015

Michelle K. Lee

Michelle K. Lee
*Director of the United States Patent and Trademark Office*